US006199296B1

(12) United States Patent
Jewitt

(10) Patent No.: US 6,199,296 B1
(45) Date of Patent: Mar. 13, 2001

(54) SEAL ARRANGEMENT FOR THROUGH-AIR DRYING PAPERMAKING MACHINE

(75) Inventor: Dennis E. Jewitt, Kent (GB)

(73) Assignee: Valmet-Karlstad AB, Karlstad (SE)

( * ) Notice: Subject to any disclaimer, the term of this patent is extended or adjusted under 35 U.S.C. 154(b) by 0 days.

(21) Appl. No.: 09/464,993

(22) Filed: Dec. 16, 1999

(51) Int. Cl.[7] ..... D06F 58/00

(52) U.S. Cl. ..... 34/115; 34/117; 34/119; 34/125; 34/242

(58) Field of Search ..... 34/111, 114, 115, 34/117, 119, 124, 125, 242; 162/115, 205, 207

(56) References Cited

U.S. PATENT DOCUMENTS

| | | | | |
|---|---|---|---|---|
| 3,432,936 | | 3/1969 | Cole et al. . | |
| 3,812,000 | | 5/1974 | Salvucci, Jr. et al. . | |
| 3,821,068 | | 6/1974 | Shaw . | |
| 4,036,684 | | 7/1977 | Schmitt et al. . | |
| 4,124,942 | * | 11/1978 | Ohls et al. | 34/115 |
| 4,194,947 | | 3/1980 | Huostila et al. . | |
| 4,247,990 | | 2/1981 | Ohls et al. . | |
| 4,481,722 | * | 11/1984 | Guy et al. | 34/115 X |
| 4,876,803 | * | 10/1989 | Wedel | 34/117 |
| 5,020,241 | * | 6/1991 | Fleissner | 34/115 |
| 5,477,624 | * | 12/1995 | Haessner et al. | 34/117 |
| 5,569,359 | * | 10/1996 | Joiner | 162/207 X |
| 5,575,084 | | 11/1996 | Vuorinen . | |
| 5,581,906 | | 12/1996 | Ensign et al. . | |
| 5,584,126 | | 12/1996 | Ensign et al. . | |
| 5,584,128 | | 12/1996 | Ensign et al. . | |
| 5,625,961 | | 5/1997 | Ensign et al. . | |
| 5,887,358 | * | 3/1999 | Bischel et al. | 34/115 |
| 5,993,979 | * | 8/1999 | Wedel | 34/124 X |
| 6,083,346 | * | 7/2000 | Hermans et al. | 162/207 X |

* cited by examiner

*Primary Examiner*—Stephen Gravini
(74) *Attorney, Agent, or Firm*—Alston & Bird LLP

(57) ABSTRACT

An apparatus for drying a wet web of paper comprising at least one through-air dryer, each dryer including a rotatable cylinder having a porous cylindrical deck, at least one continuous drying fabric wrapped about a portion of the circumference of the deck, a plurality of fabric support members positioned relative to each cylinder so as to direct the fabric and the web onto and from each cylinder, and a hood and a plenum cooperating to form a substantially sealed enclosure containing each cylinder. The drying fabric is adapted to support and transport the paper web about a portion of the circumference of the cylinder of each dryer. The fabric support members preferably include a first fabric support member located at an upstream end of the apparatus for directing the wet web and the fabric onto the cylinder of the upstream through-air dryer, and a second fabric support member located at a downstream end of the apparatus for directing the web and the fabric from the cylinder of the downstream through-air dryer. The hood further interacts with at least the first and the second fabric support members and covers a portion of each cylinder about which the fabric and the wet web are wrapped. Further, the plenum cooperates with the hood and at least the first and the second fabric support members to substantially seal the enclosure containing each cylinder. Preferably, and more specifically, the plenum forms seals with both the first and the second fabric support members with at least one of the seals being formed by the plenum sealingly engaging the fabric wrapped about the corresponding fabric support member.

26 Claims, 4 Drawing Sheets

SEAL ARRANGEMENT FOR THROUGH-AIR DRYING PAPERMAKING MACHINE

FIELD OF THE INVENTION

The present invention relates to paper making machines and, more particularly, to a seal arrangement for a through-air dryer in a paper making machine.

BACKGROUND OF THE INVENTION

Generally, in a paper making machine, a wet paper web is formed in a former on a forming fabric and then carried by the forming fabric, or transferred therefrom to a drying fabric by which the web is then carried, through a drying section where it is at least partially dried. Water removal in the drying section may be accomplished through the use of one or more through-air dryers depending on the desired degree of drying of the paper web. Through-air drying typically works by passing a hot gas such as air, or a hot vapor such as steam, through the moist web using applied differential pressure. Water is then removed from the web by the drying medium principally by the mechanism of forced convection.

A rotary through-air dryer (TAD) is generally the most common type of through-air dryer used in paper making machines where non-compacting drying of the paper web is desired. A rotary TAD typically consists of a rotatable cylinder or drum with a porous face or deck. The porous deck is generally a welded honeycomb structure which gives the deck a high open area while providing the cylinder or drum with high structural strength. Further, since a paper web lacks strength, especially when wet, an air permeable backing or carrying fabric is typically required to support the paper web through the TAD. The fabric is configured to carry the paper web thereupon as it generally wraps about a major portion of the circumference of the cylinder. A number of fabric support members are also generally provided, both at the upstream side and the downstream side of the cylinder, to support and direct the fabric and the web onto and from the cylinder.

With the fabric and the paper web wrapped about the cylinder, the drying medium is then passed through both the fabric and the web to dry the web. For a rotary TAD, the hot air or steam drying medium supplied to dry the paper web may be directed to flow through the web and into the interior of the cylinder (an inward flow configuration) or may be directed out of the interior of the cylinder through the web (an outward flow configuration). Further, the drying medium may be directed through the deck twice in a cross-flow configuration, or may be conveyed between one or both ends or heads of the cylinder and the deck in an axial exhaust or axial supply configuration.

In order for rotary TADs to be effective in drying the paper web, the drying medium must be directed through the web and the carrying fabric as efficiently as possible. Thus, for the differential pressure to be applied to the rotary TAD to force the drying medium through the wet paper web and the fabric, the cylinder is enclosed to "duct" the drying medium from a supply to an exhaust. An enclosure for the cylinder typically includes a hood surrounding the portion of the cylinder about which the fabric and paper web are wrapped. The hood may be configured as a single-piece component or as a multi-piece assembly to facilitate serviceability. In some instances, a separate plenum may then be required to cover the "dead zone" of the deck over which the fabric and web are not wrapped. However, rotary through-air dryers are typically difficult to seal because of the need to pass the fabric and paper web into and out of the enclosure formed by the hood and, in some cases, a plenum. Inefficient sealing of the enclosure may lead to leakage, thus reducing the drying capacity of the dryer. Accordingly, several different methods have been devised for sealing a rotary TAD.

For example, U.S. Pat. No. 3,423,936 to Cole et al. discloses an inward flow rotary TAD arrangement wherein hot air is supplied through a hood covering the cylinder and the hood forms non-contacting seals with the drying fabric. The drying air flows through the paper web, the drying fabric(s), and through the deck of the cylinder into the interior thereof. The '936 patent discloses two methods for exhausting the air from the interior of the cylinder. As shown in FIG. 2 of the '936 patent, in a cross-flow exhaust arrangement, the air is exhausted through the dead zone of the cylinder and collected in an exhaust plenum disposed at that location. The plenum is arranged to form contact seals with the porous cylinder at the leading and trailing ends of the dead zone. The problem with attempting to form a seal with the porous cylinder is that a good seal may be difficult to achieve due to the expansive open areas in the deck of the cylinder and, accordingly, this design may tend to leak. Further, the seal at the leading edge of the plenum, with respect to the rotation of the cylinder, may have a tendency to dig into the cylinder and cause damage to the plenum and/or cylinder.

In addition, FIGS. 6 and 7 of the '936 patent disclose an alternate arrangement of a rotary TAD having an axial exhaust through one of the heads of the cylinder. However, the dead zone of the cylinder must still be sealed to prevent leakage of the drying medium therethrough. Accordingly, a stationary external shield is mounted over the dead zone with a slight clearance at the ends of the shield, between it and the outside surface of the rotating cylinder. The disadvantage of this configuration is that a non-contacting seal against a TAD deck is prone to leakage.

In another example, U.S. Pat. No. 3,303,576 to Sisson discloses an outward flow rotary TAD arrangement with a cross-flow configuration, using air as the drying medium. Heated air is flowed through a plenum covering the dead zone of the porous cylinder, through the deck and into the interior of the cylinder. The air then flows back out through the deck, the paper web, and the drying fabric(s) into a collection hood for exhausting the air from the TAD. According to the '576 patent, the supply plenum forms non-contacting seals at the interfaces of the deck and the fabric in the general location of the idlers, while the hood forms contacting trailing seals with corresponding idlers.

However, the rotary TAD configuration as disclosed by the '576 patent is limited to an outward flow configuration. An outward flow configuration in a rotary TAD is disadvantageous in that special provisions must be made in order to prevent the web from being damaged by the surface of the cylinder and the maximum pressure differential that can be applied (and thus the air flow per unit area) is limited by the maximum allowable fabric tension divided by the cylinder diameter. This relationship restricts the economic size of outward flow TAD cylinders since increasing the size of the cylinder results in a reduction in the allowable differential pressure and thus the air flow per unit area.

In a further example, U.S. Pat. No. 4,247,990 to Ohls et al. discloses an inward flow rotary TAD using air or steam as the drying medium. Both cross-flow and axial flow configurations are disclosed. The paper web and the drying fabric are directed onto and from the TAD cylinder between two or more sealing rolls disposed adjacent the cylinder. An enclosure is provided to seal the interior thereof from the outer atmosphere. Since the fabric and the web pass between the sealing rolls, the hood covering the portion of the cylinder about which the fabric is wrapped, as well as the plenum covering the dead zone, are sealed to the corresponding sealing rolls with sealing strips. However, passing the web and the fabric through a pair of adjacent rolls may have the effect of compacting the paper web and densifying the resulting paper sheet. Where the paper making machine is used to produce tissue and towel products, densification of the paper web is undesirable since it tends to reduce absorbency and softness of the paper product while increasing its stiffness.

Thus, it would be desirable to provide a rotary through-air dryer for a paper making machine capable of being configured in both a cross-flow and an axial flow configuration and capable of handling both inward flow and outward flow processes. It would be further desirable for such a through-air dryer to be effectively sealed. Effective sealing of the TAD would have benefits such as increasing the energy efficiency of the apparatus by minimizing leaks, allowing the use of smaller fans due to the reduced leakage, and permitting a greater pressure differential (and, consequently, a higher air flow per unit area) to be achieved. These benefits would further allow the apparatus to be reduced in size, thus resulting in a reduced capital cost. Such an improved TAD would further desirably provide an effective sealing system without undesirably compacting the paper web and without the risk of seals digging into the porous cylinder.

SUMMARY OF THE INVENTION

The above and other needs are met by the present invention which, in one embodiment, provides an apparatus for drying a wet web of paper comprising at least one through-air dryer, each dryer including a rotatable cylinder having a porous cylindrical deck, at least one continuous drying fabric wrapped about a portion of the circumference of the deck, a plurality of fabric support members positioned relative to each cylinder so as to direct the fabric onto and from each cylinder, and a hood and a plenum cooperating to form a substantially sealed enclosure containing each cylinder. The drying fabric is adapted to support and transport the wet paper web about a portion of the circumference of the cylinder of each dryer. The fabric support members preferably include a first fabric support member located at an upstream end of the apparatus for directing the wet web and the fabric onto the cylinder of the through-air dryer, and a second fabric support member located at a downstream end of the apparatus for directing the web and the fabric from the cylinder of the through-air dryer. The hood further interacts with at least the first and the second fabric support members and covers the portion of each cylinder about which the fabric and the web are wrapped. In addition, the plenum cooperates with the hood and at least the first and the second fabric support members to substantially seal the enclosure containing each cylinder. Preferably, and more specifically, the plenum forms seals with both the first and the second fabric support members with at least one of the seals being formed by the plenum sealingly engaging the fabric wrapped about the corresponding fabric support member. In another advantageous embodiment, the first and the second fabric support members are closely spaced about the cylinder such that the dead zone is sealed by a seal mechanism sealingly engaging the fabric wrapped about the fabric support members. In still another advantageous embodiment, the first and the second fabric support members are positioned adjacent each other closely to provide a minimal gap between the support members so as to effectuate a seal therebetween.

In accordance with another embodiment of the invention, the apparatus may comprise one or more rotary through-air dryers each having a rotatable cylinder and a plurality of fabric support members disposed adjacent thereto for directing the fabric and the paper web onto and from each cylinder. The through-air dryer may be configured to provide an inward flow of the drying medium, such as hot air or steam, wherein the drying medium is flowed from the exterior of the cylinder through the paper web, the fabric, and the deck and into the interior of the cylinder. For an inward flow configuration, a single drying fabric is used such that the paper web is supported on an outer surface thereof and the fabric lies between the paper web and the deck as the web is transported about the through-air dryer. Alternatively, the through-air dryer may be configured in an outward flow arrangement wherein the drying medium flows from the interior of the cylinder through the deck, the drying fabric, and the paper web to the exterior of the cylinder. Preferably, with an outward flow configuration, the paper web is supported between two drying fabrics as it is carried about the cylinder of the through-air dryer.

The fabric support members used to direct the fabric and the web onto and from the cylinders may take different forms. In one embodiment of the present invention, the first fabric support member may comprise a vacuum box disposed within the loop of the fabric. The plenum is then engaged with the vacuum box by a seal, such as a flexible membrane, a soft gasket, or the like, capable of withstanding occasional movement between the vacuum box and the plenum. The seal is also preferably configured to allow for adjustment of the position of the vacuum box with respect to the fabric. In an alternate embodiment, at least one of the fabric support members may comprise a rotatable roll, wherein the paper web is then wrapped about a portion of the circumference thereof such that a drying fabric is disposed outwardly of the paper web from the roll. Where a fabric support member comprises a rotatable roll having a drying fabric and the paper web wrapped thereabout, the plenum forms a seal with the roll without compacting the paper web. Preferably, the seal at the roll is formed using a doctor holder assembly having a trailing blade and disposed on the plenum such that the trailing blade engages the drying fabric disposed outwardly of the paper web from the roll. Accordingly, the plenum seals the "dead zone" of the cylinder between the guides about which the fabric and the web are not wrapped. In a through-air dryer with a cross flow configuration, the plenum may comprise either the inlet ducting or the exhaust ducting for the drying medium, with the hood used to exhaust or supply the drying medium, respectively. Alternatively, for an axial flow configuration, the drying medium is flowed between the interior of the hood and at least one end or head of the cylinder via the interior of the cylinder, in which case the plenum covering the dead zone of the cylinder comprises a shield preventing escape of the drying medium through the dead zone.

In embodiments of the present invention where the first and the second fabric support members are closely spaced, the dead zone may be sealed by a sealing mechanism engaging the fabric support members with a doctor holder/trailing blade assembly sealingly engaging the fabric disposed outwardly of the fabric support members. Further, the fabric support members may be closely spaced such that the minimal gap therebetween effectively seals the dead zone. Since exhausting of the drying medium through the dead zone is restricted in the embodiments having closely spaced first and second fabric support members, such embodiments are advantageously configured for axial flow of the drying medium.

Thus, embodiments of the present invention provide a rotary through-air dryer for a paper making machine capable of being configured in both a cross-flow and an axial flow configuration and capable of handling both inward flow and outward flow processes, while being effectively sealed. An effectively sealed TAD increases the energy efficiency of the apparatus by minimizing leaks, allows the use of smaller fans due to the reduced leakage, and permits a greater pressure differential (and, consequently, a higher air flow per unit area) to be achieved. These benefits allow the apparatus to be reduced in size, thus resulting in a reduced capital cost. The improved TAD also provides an effective sealing system without undesirably compacting the paper web and without the risk of seals digging into the porous cylinder.

BRIEF DESCRIPTION OF THE DRAWINGS

Some of the advantages of the present invention having been stated, others will appear as the description proceeds, when considered in conjunction with the accompanying drawings in which.

DETAILED DESCRIPTION OF A PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
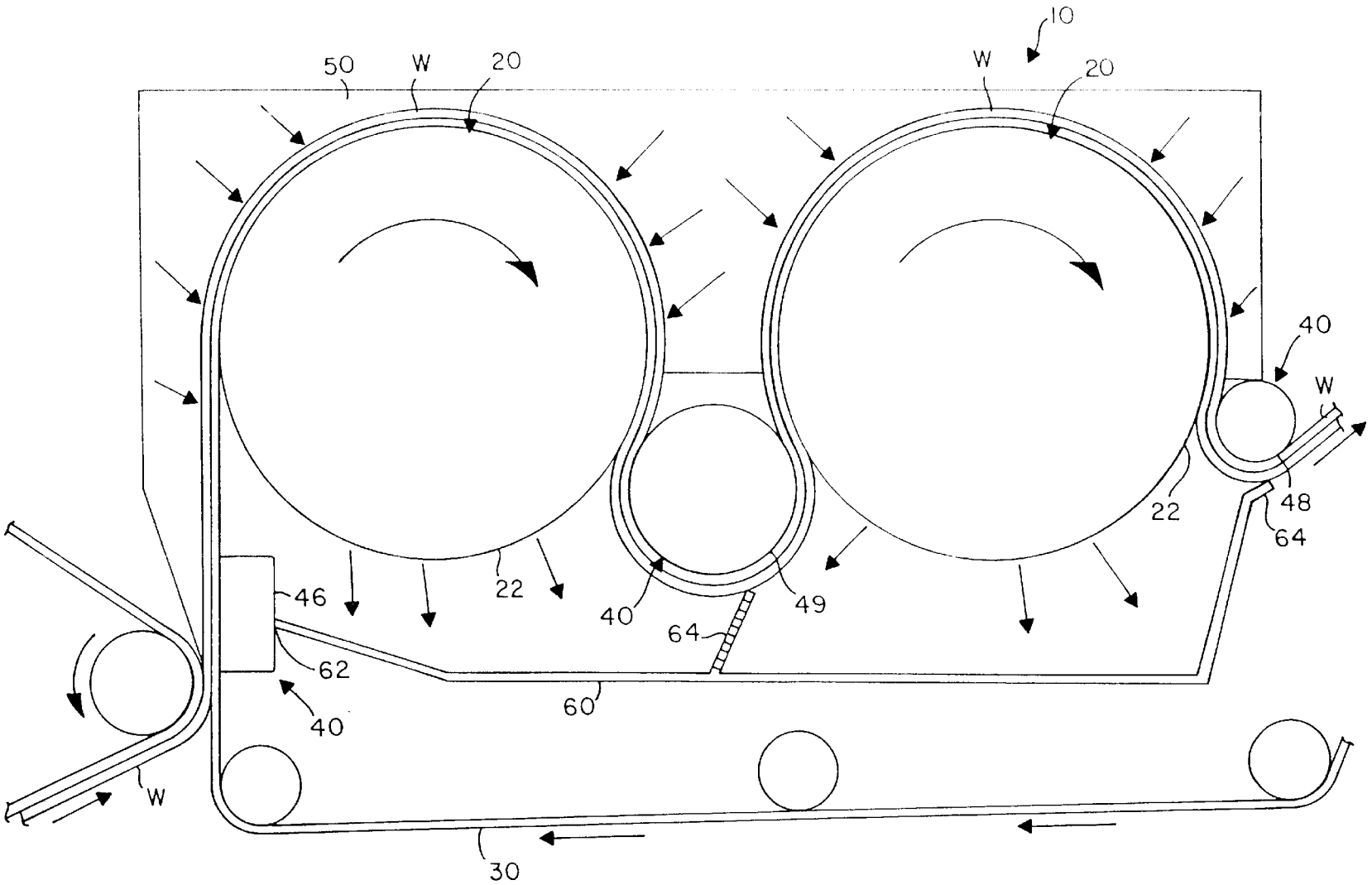
FIG. 1 is a schematic representation illustrating one embodiment of the present invention having two adjacent through-air dryers sharing a common hood and configured in an inward cross flow arrangement.

FIG. 1 discloses one embodiment of an apparatus for drying a wet web of paper W, more particularly a rotary through-air drying apparatus, indicated generally by the numeral 10, which includes the features of the present invention. The through-air drying (TAD) apparatus 10 comprises a pair of rotatable cylinders 20, at least one continuous drying fabric 30 wrapped about a portion of the circumference of each cylinder 20, a plurality of fabric support members 40 disposed adjacent each cylinder 20, a hood 50 covering the portion of each cylinder 20 about which the fabric 30 is wrapped, and a plenum 60 for covering the portion of each cylinder 20 about which the fabric 30 is not wrapped.

The rotatable cylinder 20 generally comprises a porous cylindrical deck 22 and defines two opposing ends or heads (not shown) at each end thereof. The deck 22 is typically a welded honeycombed structure providing high structural strength while having a high amount of open area therethrough. The single drying fabric 30 is a continuous belt of porous construction forming a loop within which each cylinder 20 is disposed. The fabric 30 is configured to transport a wet web of paper W about the cylinders 20 of the through-air dryers 10 with the aid of the fabric support members 40. The plurality of fabric support members 40 may comprise, for example, a vacuum box, a rotatable roll, or the like. The upstream cylinder 20 includes a first fabric support member 46 for directing the fabric 30 and the web W onto the cylinder 20 and the downstream cylinder 20 includes a second fabric support member 48 for directing the fabric 30 and the web W from the cylinder 20. Where the drying section comprises two or more through-air dryers 10, a single rotatable roll 49 may function both to direct the fabric 30 and web W from the upstream cylinder 20 and to direct the fabric 30 and web W onto the downstream cylinder 20. The fabric support members 40 are generally arranged adjacent to or engaged against each cylinder 20 such that the fabric 30 is wrapped about a major portion of the circumference of the cylinder 20.

A through-air dryer 10 may be configured according to the desired performance characteristics thereof. For instance, the through-air dryer 10 may be configured in an inward flow arrangement whereby the drying medium flows from the exterior of the cylinder 20 through the paper web W, the drying fabric 30, and the deck 22 and into the interior of the cylinder 20. Alternatively, the through-air dryer 10 maybe configured in an outward flow arrangement whereby the drying medium flows from the interior of the cylinder 20 through the deck 22, the drying fabric 30, and the paper web W to the exterior of the cylinder 20. Further, the through-air dryer 10 may be arranged in an axial flow configuration whereby the drying medium flows between the exterior of the cylinder 20 and at least one of the ends or heads of the cylinder 20 via the deck 22 and the interior of the cylinder 20. Alternatively, the through-air dryer 10 may be configured in a cross flow arrangement whereby the drying medium is flowed both into and out of the interior of the cylinder 20 through the deck 22. For example, in an inward cross flow configuration such as shown in FIG. 1, the drying medium is flowed from the exterior of the cylinder 20 through the paper web W, the fabric 30, and the deck 22 into the interior of the cylinder 20 before being exhausted through the deck 22 in the dead zone.

Thus configured, the through-air dryer 10 requires provisions for directing the drying medium through the paper web W to perform the desired drying function and then to exhaust the drying medium therefrom. Typically, a hood 50 is provided to cover the portion of the cylinder 20 about which the fabric 30 and the web W are wrapped. Preferably, the hood 50 covers the cylinder 20 and extends from the first fabric support member 46 at the upstream end of the dryer 10 to the second fabric support member 48 at the downstream end. Where the drying section includes more than one through-air dryer 10, each cylinder 20 may be provided with an individual hood, or a common hood may cover two or more cylinders. Further, where a common hood is used to cover a plurality of cylinders 20, the common hood may contain interior partitions to control the flow and the distribution of the drying medium. In one embodiment of the present invention, the hood 50 interacts with the first and the second fabric support members 46 and 48 to provide effective ducting of the drying medium through the fabric 30 and the web W between the fabric support members 46 and 48. For example, where the first fabric support member 46 comprises a vacuum box within the fabric loop 30 adjacent the upstream end of the through-air dryer 10, the hood 50 may extend to cover, or at least partially oppose, the vacuum box on the opposite side of the fabric 30 on the outer side of the loop. The vacuum box preferably engages the fabric 30 on the inner side of the loop with a ceramic or other suitable material strip. In a further example, where the hood 50 interacts with the second fabric support member 48 located at the downstream end of the through-air dryer 10, the hood 50 may extend to form a trailing contact seal with the second fabric support member 48. Depending on the configuration used, the hood 50 may be operably arranged to provide the drying medium to the through-air dryers 10 or to exhaust the drying medium therefrom. Accordingly, where the hood 50 supplies the drying medium, it is configured such that the drying medium is directed through the web and the fabric 30 about the cylinders 20 and up to, and possibly including, the first and the second fabric support members 46 and 48. In this instance, the hood 50 may not sealingly interact with the first and the second fabric support members 46 and 48 since the flow of the drying medium is directed through the web and the fabric.

As further shown in FIG. 1, the plenum 60 is used to seal the dead zone and complete the substantial enclosure of the through-air dryers 10. Depending on the configuration of the through-air dryer 10, the plenum 60 may be used to exhaust the drying medium (in an inward cross flow arrangement), to provide the drying medium to the through-air dryer 10 (in an outward cross flow arrangement), or as a shield (in either an inward or outward axial flow arrangement). In order to effectively seal the through-air dryer 10, the plenum 60 forms seals with both the first and the second fabric support members 46 and 48 via a seal mechanism. Where, for example, the first fabric support member 46 comprises a vacuum box, the plenum 60 is engaged therewith by a seal mechanism comprising a seal 62 capable of withstanding occasional movement, such as that due to thermal expansion and contraction. For instance, the seal 62 may be a flexible membrane, a soft gasket, or the like. The seal 62 is further configured to allow positioning adjustment of the first fabric support member 46 with respect to the fabric 30. The plenum 60 engages the downstream second fabric support member 48 through the use of a seal mechanism comprising a trailing contact seal arrangement 64. A trailing contact seal arrangement 64 may consist of, for example, a doctor holder assembly having a trailing blade and disposed on the plenum 60. Since the second fabric support member 48 typically has the fabric 30 and the web W wrapped about the portion thereof adjacent the dead zone, a sealing arrangement with the second fabric support member 48 requires that the web W and the fabric 30 play a role in the sealing engagement. Due to the fragile nature of the web W, a contacting seal between the plenum 60 and the second fabric support member 48 requires that the sealing member on the plenum 60 engage the fabric 30 disposed outwardly of the paper web W from the second fabric support member 48. Thus, the trailing blade of the doctor holder assembly engages the drying fabric 30 to form a seal between the plenum 60 and the second fabric support member 48. Where the drying medium is exhausted through the cylinders 20 in an axial flow arrangement or through the plenum 60 in a cross flow arrangement, the sub-atmospheric pressure created by the exhaust suction may enhance the sealing effect between the trailing contact seal arrangement 64 and the second fabric support member 48. Preferably, the trailing blade is comprised of a dry lubricating and wear-resistant non-metallic material to avoid abrasion or wear of the fabric 30. Most preferably, the trailing blade is comprised of polytetrafluouroethylene (Teflon). Further, though the plenum 60 is sealed to both the first and second fabric support members 46 and 48, additional seals may be formed with other rolls, such as roll 49, intermediately disposed between cylinders 20, also using a trailing contact seal arrangement 64 as shown in dashed line in FIG. 1, to provide isolation between adjacent through-air dryers 10.

Figure 2:
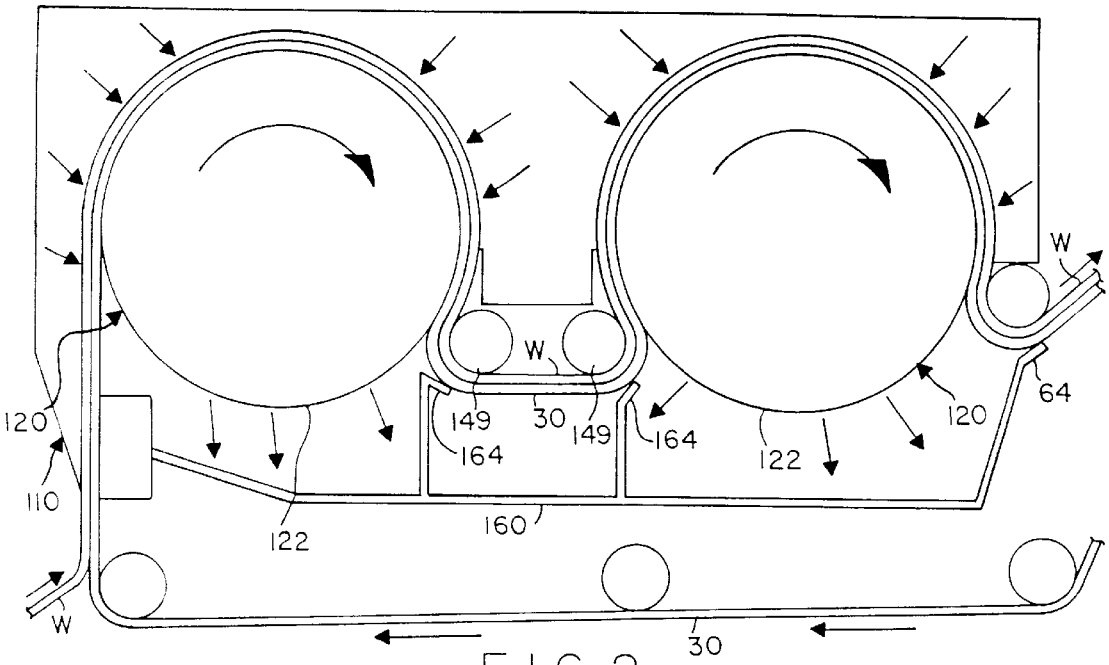
FIG. 2 is a schematic representation illustrating an alternative embodiment of the present invention having two adjacent through-air dryers sharing a common hood and configured in an inward cross flow arrangement, wherein the exhaust plenum is divided to serve individual through-air dryers.

FIG. 2 shows an alternate embodiment of the present invention wherein the drying section comprises two through-air dryers 110 having two rotatable rolls 149 disposed intermediate the cylinders 120 of the through-air dryers 110. The upstream rotatable roll 149 directs the fabric 30 and the web W from the upstream cylinder 120 and to the downstream rotatable roll 149. The downstream rotatable roll 149 then directs the fabric 30 and the web W onto the downstream cylinder 120. Further, the plenum 160 is configured to include a pair of trailing contact seal arrangements 164 each individually engaging one of the rolls 149. Since the plenum 160 is configured to exhaust the drying medium, the trailing contact seal arrangements 164 divide the plenum 160 such that the drying medium is exhausted individually from each cylinder 120. Further, FIG. 3 shows an alternate embodiment to the embodiment shown in FIG. 2, wherein the plenum 260 is configured to serve as a common exhaust for the drying medium from both cylinders 120.

Figure 3:
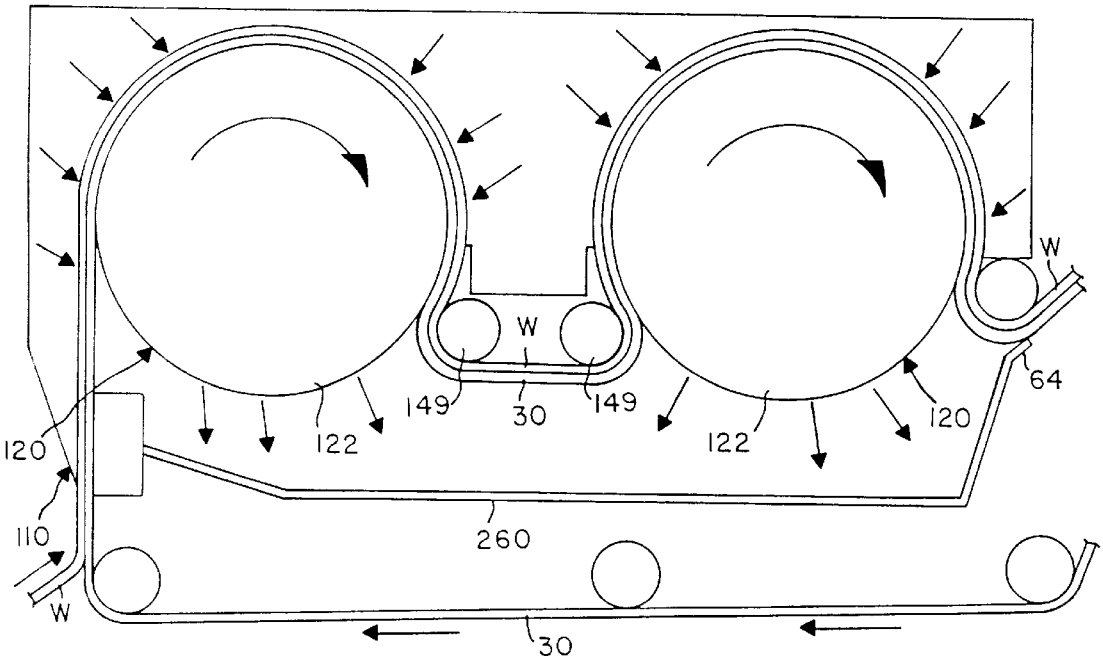
FIG. 3 is a schematic representation illustrating an alternative embodiment of the present invention having two adjacent through-air dryers sharing a common hood and configured in an inward cross flow arrangement, wherein a common exhaust plenum serves both through-air dryers.
Figure 4:
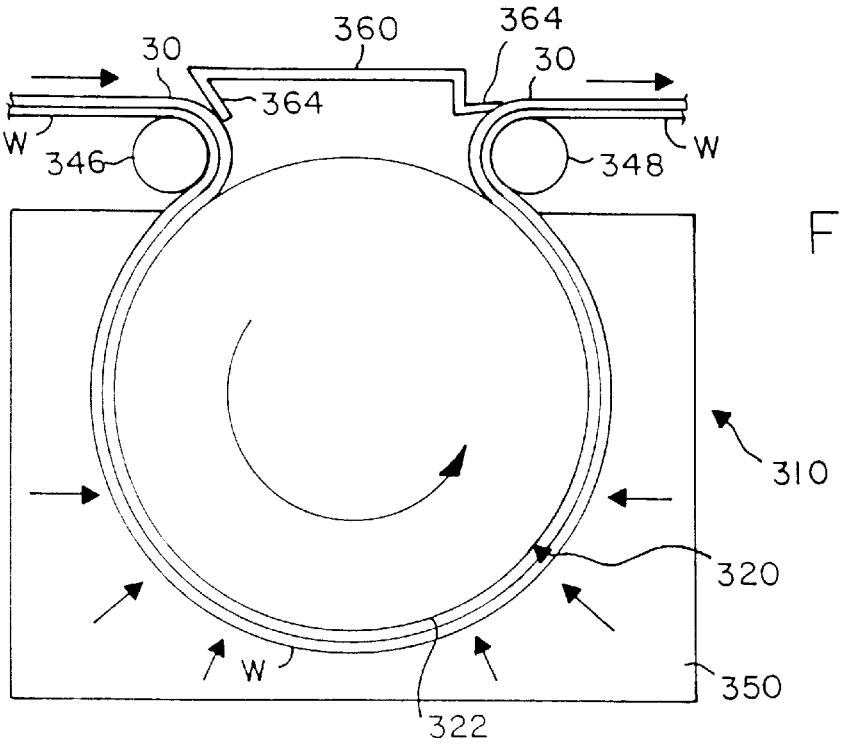
FIG. 4 is a schematic representation illustrating an alternative embodiment of the present invention having a single through-air dryer configured in an inward axial flow arrangement, wherein the dead zone is sealed by a shield having seal mechanisms disposed at each end.
Figure 5:
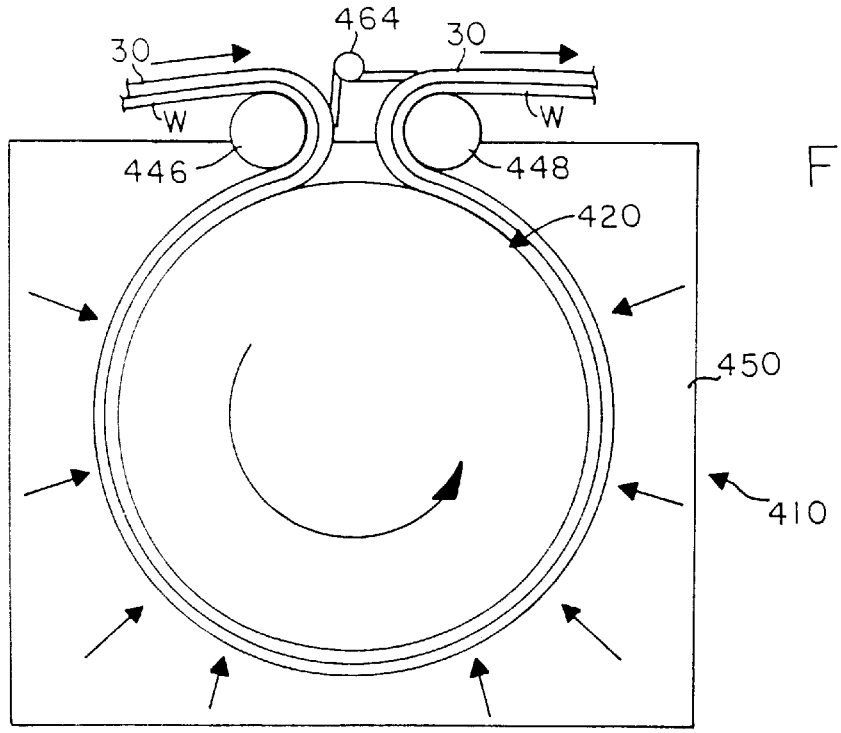
FIG. 5 is a schematic representation illustrating an alternative embodiment of the present invention having a single through-air dryer configured in an inward axial flow arrangement, wherein the dead zone is sealed by a seal mechanism interacting with opposing fabric support members and the wrap area of the through-air dryer is increased.

Embodiments of the present invention as shown in FIGS. 1–3 illustrate inward cross flow configurations whereby the hood comprises the supply for the drying medium and the plenum functions to exhaust the drying medium from the through-air dryer. These configurations may alternatively function in an outward cross flow arrangement whereby the plenum supplies the drying medium which is then exhausted through the hood. For outward flow configurations, the paper web is preferably transported about the through-air dryers while sandwiched between two drying fabrics. Further, as additionally shown in FIG. 4, where the through-air dryer 310 is configured in an axial flow arrangement (whereby the drying medium is either supplied or exhausted through the ends or heads of the cylinder 320), the plenum 360 comprises a shield sealingly engaging the first and the second fabric support members 346 and 348 with sealing mechanisms comprising trailing contact seal arrangements 364. Further, FIG. 5 shows an alternate embodiment to the embodiment shown in FIG. 4 where the through-air dryer 410 is configured in an axial flow arrangement and the first and the second fabric support members 446 and 448 are disposed adjacent the cylinder 420 and spaced within close proximity to each other. With the first and the second fabric support members 446 and 448 being closely spaced, the wrap area (the area about the cylinder 420 which is covered by the web W and the fabric 30 at any given time) is increased and results in increased drying of the web W. Further, the close spacing allows the cylinder 420 to be substantially enclosed by a sealing mechanism 464 sealingly engaging the fabric 30 wrapped about both the first and the second fabric support members 446 and 448. The sealing mechanism 464 may comprise, for example, a doctor holder assembly having a pair of trailing blades engaging the fabric 30 individually about each of the fabric support members 446 and 448 or a pair of doctor holder assemblies, each having a single trailing blade and performing the same function.

Figure 6:
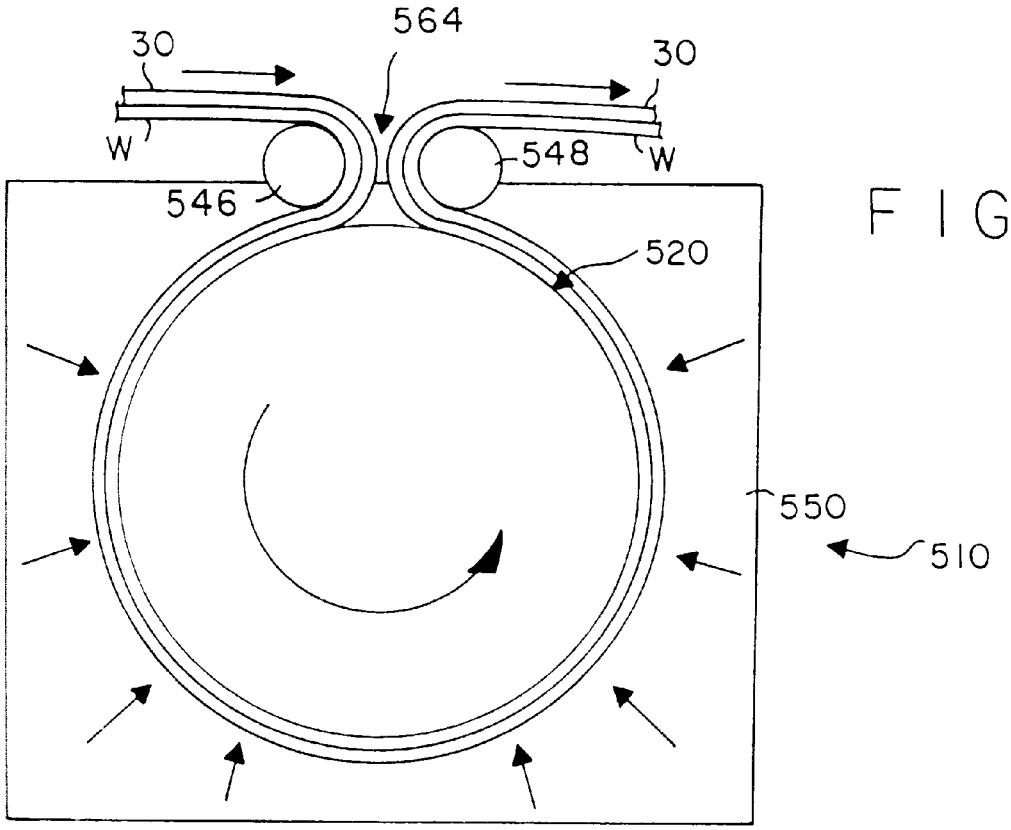
FIG. 6 is a schematic representation illustrating an alternative embodiment of the present invention having a single through-air dryer configured in an axial flow arrangement, wherein opposing fabric support members are closely spaced to effectuate a seal while increasing the wrap area of the through-air dryer.

FIG. 6 shows an alternate embodiment to the embodiment shown in FIG. 5 where the first and the second fabric supporting members 546 and 548 are separated by a minimal gap 564. Through the minimal gap 564, the fabric 30 wrapped about the first fabric support member 546 may contact the same fabric 30 wrapped about the cylinder 520 and exiting therefrom about the second fabric support member 548, thereby enclosing the cylinder 520. Alternatively, the minimal gap 564 may be sized to allow some leakage into the cylinder 520 that is axially exhausted while still enabling the axial exhaust flow to exhaust the drying medium passing through the web W and the fabric 30 into the interior of the cylinder 520.

Thus, the present invention facilitates improved sealing systems for a through-air dryer. Improved seals minimize the hot drying medium from leaking out of the system and also minimize cold air from leaking in, thus improving the energy efficiency of the apparatus. Further, by effectively sealing the system and minimizing or reducing leaks, smaller fans may be used to supply and exhaust the drying medium, thus resulting in cost savings in power and equipment. In addition, the improved seals allow a greater differential pressure to be applied across the deck, which translates into a higher air flow per unit area. A higher air flow per unit area more efficiently dries the web and, thus, the entire apparatus may be reduced in size with consequent savings in capital costs.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for drying a wet web of paper comprising:

at least one through-air dryer, each dryer including a rotatable cylinder having a porous cylindrical deck;

at least one continuous drying fabric wrapped about a portion of the circumference of the deck and adapted to transport the wet paper web thereabout with the wet web supported on a surface of the fabric;

a plurality of fabric support members positioned relative to each cylinder so as to direct the fabric and the web onto and from each cylinder, the fabric support members including a first fabric support member located at an upstream end of the apparatus for directing the fabric and wet web onto the deck, and a second fabric support member located at a downstream end of the apparatus for directing the fabric and the web from the deck;

a hood interacting with at least the first and the second fabric support members and covering a portion of each cylinder about which the fabric and the web are wrapped, the hood being operable for passing drying air between an interior of the hood and an interior of each cylinder; and a plenum cooperating with the hood and at least the first and the second fabric support members to form a substantially sealed enclosure containing each cylinder, the plenum having at least one sealing mechanism forming seals with both the first and the second fabric support members, with at least one of the seals being formed by the sealing mechanism sealingly engaging the fabric wrapped about the corresponding fabric support member.

2. An apparatus according to claim 1 wherein said apparatus comprises a single through-air dryer having a single cylinder, the first and the second fabric support members being disposed adjacent the deck of the cylinder.

3. An apparatus according to claim 1 wherein said apparatus comprises a pair of through-air dryers each having a cylinder, the first fabric support member being disposed adjacent the deck of an upstream one of the cylinders and the second fabric support member being disposed adjacent the deck of a downstream one of the cylinders.

4. An apparatus according to claim 1 wherein the first fabric support member comprises a vacuum box and the plenum is engaged therewith by a sealing mechanism comprising a seal capable of withstanding occasional movement.

5. An apparatus according to claim 4 wherein the first fabric support member comprises a vacuum box and the plenum is engaged therewith by a sealing mechanism comprising at least one of a flexible membrane and a soft gasket.

6. An apparatus according to claim 1 wherein at least one of the fabric support members comprises a rotatable roll having said at least one drying fabric and the paper web wrapped about a portion of the circumference thereof and wherein at least one of the drying fabrics is disposed outwardly of the paper web from the roll.

7. An apparatus according to claim 6 wherein said at least one sealing mechanism comprises a doctor holder assembly having a trailing blade and disposed adjacent said roll such that the trailing blade engages the drying fabric on said roll and forms a seal thereby.

8. An apparatus according to claim 7 wherein the trailing blade is comprised of a dry lubricating and wear resistant nonmetallic material.

9. An apparatus according to claim 7 wherein the trailing blade is comprised of polytetrafluouroethylene.

10. An apparatus according to claim 1 including at least two adjacent through-air dryers and having at least one intermediate roll disposed between adjacent cylinders about a portion of the circumference of which the fabric and the paper web are wrapped, said plenum further forming a seal with the intermediate roll by said at least one sealing mechanism sealingly engaging the drying fabric wrapped thereabout.

11. A through air dryer for drying a wet web of paper in a paper making machine, said dryer comprising:

a rotatable cylinder having a porous cylindrical deck;

at least one continuous drying fabric wrapped about a portion of the circumference of the deck for transporting the web thereabout with the web supported on a surface of the fabric;

a plurality of fabric support members positioned relative to the cylinder so as to direct the fabric and wet web onto and from the cylinder, the fabric support members including a first fabric support member located at an upstream end of the cylinder and disposed adjacent the deck for directing the fabric and wet web thereonto, and a second fabric support member located at a downstream end of the cylinder and disposed adjacent the deck for directing the fabric and the web therefrom;

a hood interacting with at least the first and the second fabric support members and covering the portion of the cylinder about which the fabric and the web are wrapped, the hood being operable for passing drying air between the interior of the hood and the interior of the cylinder; and a plenum cooperating with the hood and at least the first and the second fabric support members to form a substantially sealed enclosure containing the cylinder, the plenum having at least one sealing mechanism forming seals with both the first and the second fabric support members with at least one of the seals being formed by the sealing mechanism sealingly engaging the drying fabric wrapped about the corresponding fabric support member.

12. A dryer according to claim 11 wherein the first fabric support member comprises a vacuum box and the plenum is engaged therewith by a sealing mechanism comprising a seal capable of withstanding occasional movement.

13. A dryer according to claim 12 wherein the first fabric support member comprises a vacuum box and the plenum is engaged therewith by a sealing mechanism comprising at least one of a flexible membrane and a soft gasket.

14. A dryer according to claim 11 wherein at least one of the fabric support members comprises a rotatable roll having said at least one drying fabric and the paper web wrapped about a portion of the circumference thereof and wherein at least one of the drying fabrics is disposed outwardly of the paper web from the roll.

15. A dryer according to claim 14 wherein said at least one sealing mechanism comprises a doctor holder assembly having a trailing blade and disposed adjacent said roll such that the trailing blade engages the drying fabric on said roll and forms a seal thereby.

16. A dryer according to claim 15 wherein the trailing blade is comprised of a dry lubricating and wear resistant nonmetallic material.

17. A dryer according to claim 15 wherein the trailing blade is comprised of polytetrafluouroethylene.

18. A system for enclosing a through-air dryer having a rotatable cylinder with a porous cylindrical deck and having at least one continuous drying fabric wrapped about a portion of the circumference thereof adapted to transport a wet paper web thereabout, said system comprising:

a plurality of fabric support members positioned relative to the cylinder so as to direct the drying fabric and the wet web onto and from the cylinder, the fabric support members including a first fabric support member located at an upstream end of the cylinder and disposed adjacent the deck for directing the fabric and the wet web thereonto, and a second fabric support member located at a downstream end of the cylinder and disposed adjacent the deck for directing the fabric and the web therefrom;

a hood interacting with at least the first and the second fabric support members and covering the portion of the cylinder about which the fabric and the web are wrapped, the hood being operable for passing drying air between the interior of the hood and the interior of the cylinder; and a plenum cooperating with the hood and at least the first and the second fabric support members to form a substantially sealed enclosure containing the cylinder, the plenum having at least one sealing mechanism forming seals with both the first and the second fabric support members with at least one of the seals being formed by the sealing mechanism sealingly engaging the drying fabric wrapped about the corresponding fabric support member.

19. A system according to claim 18 wherein one of the fabric support members comprises a vacuum box and the plenum is engaged therewith by a sealing mechanism comprising a seal capable of withstanding occasional movement.

20. A system according to claim 19 wherein one of the fabric support members comprises a vacuum box and the plenum is engaged therewith by a sealing mechanism comprising at least one of a flexible membrane and a soft gasket.

21. A system according to claim 18 wherein at least one of the fabric support members comprises a rotatable roll having said at least one drying fabric and the paper web wrapped about a portion of the circumference thereof and wherein at least one of the drying fabrics is disposed outwardly of the paper web from the roll.

22. A system according to claim 21 wherein said at least one sealing mechanism comprises a doctor holder assembly having a trailing blade and disposed adjacent said roll such that the trailing blade engages the drying fabric on said roll and forms a seal thereby.

23. A system according to claim 22 wherein the trailing blade is comprised of a dry lubricating and wear resistant nonmetallic material.

24. A system for enclosing a through-air dryer having a rotatable cylinder with a porous cylindrical deck and having at least one continuous drying fabric wrapped about a portion of the circumference thereof and adapted to transport a wet paper web thereabout, said system comprising:

a hood covering the portion of the cylinder about which the fabric and the web are wrapped, the hood being operable for passing drying air between the interior of the hood and the interior of the cylinder; and a plurality of fabric support members positioned relative to the cylinder so as to direct the drying fabric and the wet web onto and from the cylinder, the fabric support members interacting with at least the hood to form a substantially sealed enclosure containing the cylinder, the fabric support members including a first fabric support member disposed adjacent the deck for directing the fabric and wet web thereonto, and a second fabric support member for directing the fabric and web therefrom, the second fabric support member being disposed adjacent the deck at a minimal distance from the first fabric support member so as to effectuate a seal therebetween.

25. A system according to claim 24 wherein the first and the second fabric support members comprise rotatable rolls having said at least one drying fabric and the paper web wrapped about a portion of the circumferences thereof and wherein at least one of the drying fabrics is disposed outwardly of the paper web from said rolls.

26. A system according to claim 25 further comprising a sealing mechanism disposed adjacent said rolls such that the sealing mechanism engages the drying fabric disposed outwardly of the paper web from said rolls and thereby forms seals with both rolls.

* * * * *